US009105976B2

(12) United States Patent
Wang et al.

(10) Patent No.: US 9,105,976 B2
(45) Date of Patent: Aug. 11, 2015

(54) LINEAR RADIO FREQUENCY IDENTIFICATION ANTENNA AND METHOD FOR MANUFACTURING THE SAME

(71) Applicant: Tyco Electronics Holdings (Bermuda) No. 7 Ltd., Pembroke (BM)

(72) Inventors: Hsiang-Yaeh Wang, Taipei (TW); Yu-Ching Lin, Taipei (TW); Shuen-Fa Ju, Taipei (TW); Jiunn-Min Ju, Taipei (TW); Cheng-Nan Luo, Taipei (TW)

(73) Assignee: Tyco Electronics Holdings (Bermuda) No. 7 Limited, Pembroke (BM)

( * ) Notice: Subject to any disclaimer, the term of this patent is extended or adjusted under 35 U.S.C. 154(b) by 254 days.

(21) Appl. No.: 13/712,440

(22) Filed: Dec. 12, 2012

(65) Prior Publication Data

US 2013/0147677 A1 Jun. 13, 2013

(30) Foreign Application Priority Data

Dec. 12, 2011 (TW) ..... 100145759 A

(51) Int. Cl.
*H01Q 1/52* (2006.01)
*H01Q 1/22* (2006.01)
*H01Q 1/40* (2006.01)

(52) U.S. Cl.
CPC ..... *H01Q 1/526* (2013.01); *H01Q 1/2225* (2013.01); *H01Q 1/40* (2013.01); *Y10T 29/49016* (2015.01)

(58) Field of Classification Search
CPC ..... H01Q 1/52
USPC ..... 343/841, 866; 29/600; 235/492
See application file for complete search history.

(56) References Cited

U.S. PATENT DOCUMENTS

| | | | | |
|---|---|---|---|---|
| 6,248,199 | B1 | 6/2001 | Smulson | |
| 6,394,609 | B1 * | 5/2002 | Rodriguez et al. | 353/79 |
| 8,584,955 | B2 * | 11/2013 | Mauricia | 235/492 |
| 8,608,080 | B2 * | 12/2013 | Finn | 235/492 |
| 8,717,238 | B2 * | 5/2014 | Fogg et al. | 343/700 MS |
| 2007/0030205 | A1 * | 2/2007 | Farrell et al. | 343/703 |
| 2011/0017833 | A1 | 1/2011 | Cullen et al. | |
| 2012/0067961 | A1 * | 3/2012 | Mauricia | 235/492 |

FOREIGN PATENT DOCUMENTS

DE 102006018461 A1 10/2007

OTHER PUBLICATIONS

European Patent Office Search Report, dated Apr. 3, 2013, 6 pages.

* cited by examiner

*Primary Examiner* — Huedung Mancuso
(74) *Attorney, Agent, or Firm* — Barley Snyder

(57) ABSTRACT

A linear radio frequency identification antenna is provided and includes an insulating material, a shielding material, and a conductive wire. The shielding material connects with the insulating material to form a closed body. The conductive wire is covered by the closed body such that the conductive wire, the insulating material, and the shielding material together form a linear-shaped body.

10 Claims, 2 Drawing Sheets

LINEAR RADIO FREQUENCY IDENTIFICATION ANTENNA AND METHOD FOR MANUFACTURING THE SAME

RELATED APPLICATION DATA

This application claims the benefit of the filing dates under 35 U.S.C. §119(a)-(d) of TW Patent Application No. 100145759, filed on Dec. 12, 2011.

FIELD OF THE INVENTION

The invention relates to a linear radio frequency identification antenna and, more particularly, to a linear radio frequency identification antenna for use with portable electronic devices and for use in reducing electromagnetic interference (EMI).

BACKGROUND

Various electronic products, especially portable electronic products, such as mobile phones, notebook computers, tablet computers/panel PC, personal digital assistants (PDA), barcode identification system devices, radio frequency identification (RFID) system devices, and global positioning system (GPS) devices, are commercially available and in wide use. When compared with its identification-related counterparts, radio frequency identification (RFID) has advantages, such as long service life, high security, and all-weather operation. Radio frequency identification (RFID) advantageously features a longer sensing distance and a higher scanning speed than conventional barcode identification systems do (because barcode tags have to be identified one by one, whereas more than 200 radio frequency identification-enabled tags can be processed simultaneously). Hence, it is even predicted that radio frequency identification (RFID) can gain a portion of the market share otherwise occupied by barcode identification. As regards its system framework, a radio frequency identification (RFID) system includes an electronic tag, a reader, and a system application. A radio frequency identification (RFID) antenna is installed on the reader and designed to operate by electromagnetic sensing or by microwave technology. In general, no electric wave can penetrate a metallic barrier. Nonetheless, electric wave can divert and form a magnetic field. Hence, the RFID antenna design is typically subjected to a limitation, that is, a magnetic field has to shun any shielding effect that is likely to preclude the formation of the magnetic field, and in consequence it is necessary for the RFID antenna to be equipped with a shielding layer for blocking electromagnetic interference.

Presently, conventional RFID antennas are formed mostly from conventional coils or printed circuit boards (PCB). The conventional RFID antennas formed from coils or printed circuit boards are bulky. However, a conventional RFID antenna is typically installed on a PCB (and thus known as PCB-style RFID antenna) or on a lid (and thus known as coil-style RFID antenna.) Therefore, the RFID antenna installed on a PCB or a lid has to be covered with a large shielding layer for preventing electromagnetic interference, thereby incurring additional manufacturing costs. Accordingly, it is desired to provide an effective way of cutting the costs of a shielding layer used for preventing electromagnetic interference.

SUMMARY

It is an objective of the invention, among others, to provide a linear radio frequency identification antenna for use with portable electronic devices and for use in reducing electromagnetic interference (EMI).

The linear radio frequency identification antenna includes an insulating material, a shielding material, and a conductive wire. The shielding material connects with the insulating material to form a closed body. The conductive wire is covered by the closed body such that the conductive wire, the insulating material, and the shielding material together form a linear-shaped body.

BRIEF DESCRIPTION OF THE DRAWINGS

The invention will be explained in greater detail in the following with reference to embodiments, referring to the appended drawings, in which.

DETAILED DESCRIPTION OF THE EMBODIMENT(S)

The invention will now be described in greater detail with reference to the drawings.

Figure 1:
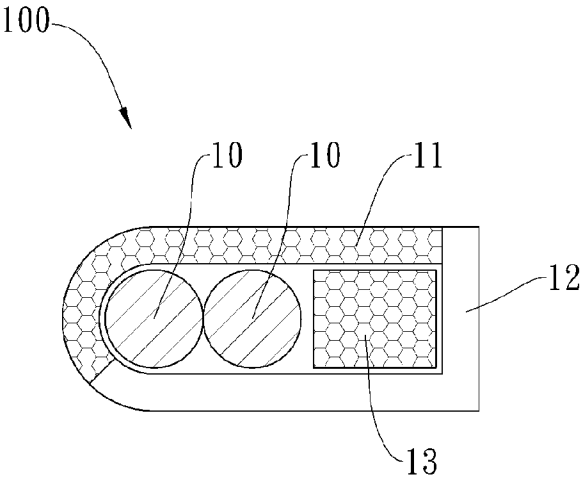
FIG. 1 is a cross-sectional view of a linear radio frequency identification antenna according to the invention.

Referring first to FIG. 1, a linear radio frequency identification antenna 100 according to the invention is shown and includes a conductive wire 10, an insulating material 11, and a shielding material 12. However, more than one conductive wire 10 could be used.

The insulating material 11 and the shielding material 12 together form a closed body for covering the conductive wire 10. The conductive wire 10, the insulating material 11, and the shielding material 12 together form a linear-shaped body by a jacket extruder.

Figure 2:
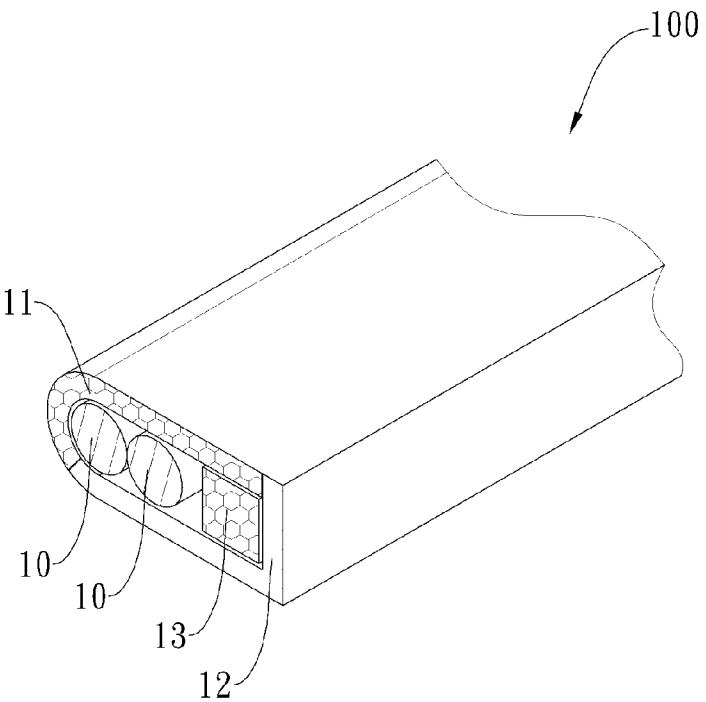
FIG. 2 is a perspective schematic view of the linear radio frequency identification antenna according to the invention.

As shown in FIG. 2, the conductive wire 10 is a copper wire, whereas the insulating material 11 is a plastic, such as PC, PET, and the like. The shielding material 12 shields electromagnetic interference (EMI) and is made of ferrite. The conductive wire 10, the insulating material 11, and the shielding material 12 are positioned in a jacket extruder (not shown). The insulating material 11 is disposed on a side of the conductive wire 10. The shielding material 12 is disposed on another side of the conductive wire 10.

Once the jacket extruder starts, the jacket extruder will compress the insulating material 11, the conductive wire 10, and the shielding material 12 and to cause the insulating material 11 and the shielding material 12 to be joined with each other. The joined insulating material 11 and the shielding material 12 enclose and cover the conductive wire 10, thereby forming the linear-shaped body, as shown in FIG. 2.

In this embodiment, the shielding material 12 is produced by mixing iron powder and glue to a determined proportion, as needed, such that in a jacket extrusion process the shielding material 12 and the insulating material 11 can be coupled together and fixed in place. As a result, the insulating material 11 and the shielding material 12 are joined to each other so as to enclose and cover the conductive wire 10.

Referring to FIG. 1 and FIG. 2, the linear radio frequency identification antenna 100 further includes a reinforcing material 13 disposed beside the conductive wire 10, wherein the insulating material 11 and the shielding material 12 are joined to each other so as to enclose and cover the conductive wire 10 and the reinforcing material 13, and enhance the rigidity of the linear-shaped body. The reinforcing material 13 is a plastic.

Figure 3:
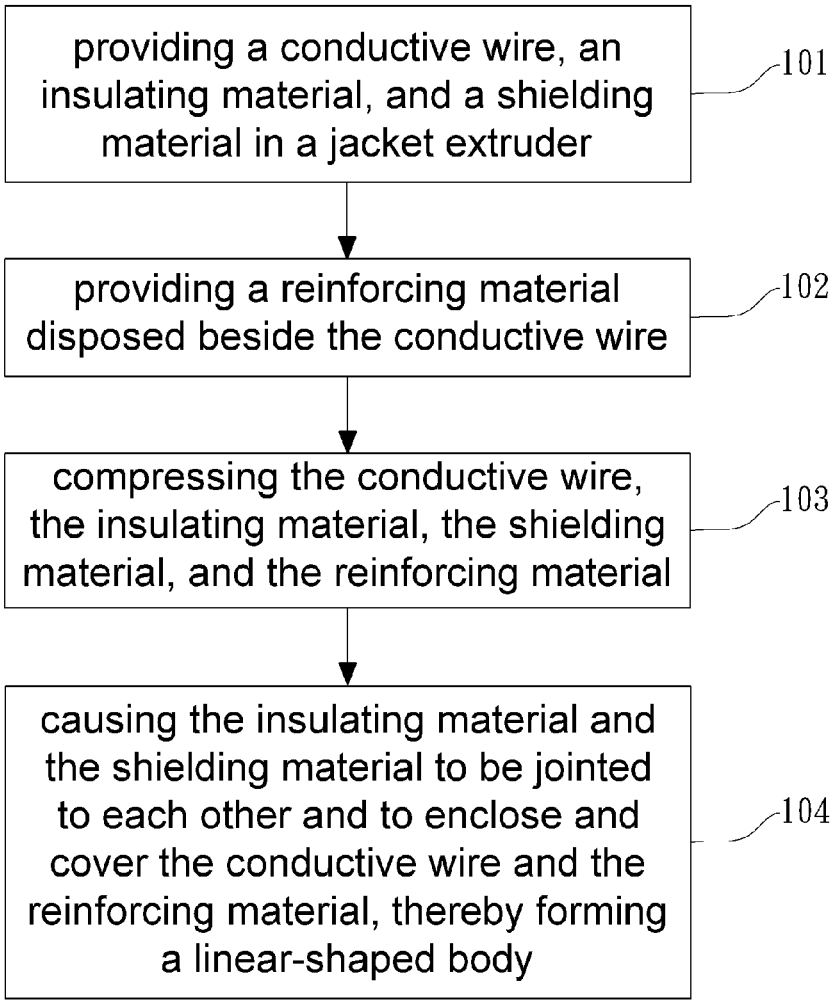
FIG. 3 is a flow chart of a method for manufacturing the linear radio frequency identification antenna according to the invention.

Now with reference to FIG. 3, a flow chart for a method of manufacturing the linear radio frequency identification antenna 100 is shown. According to the invention, the method for manufacturing the linear radio frequency identification antenna 100 includes the following described steps. Firstly, the conductive wire 10, the insulating material 11, and the shielding material 12 are provided in a jacket extruder (step 101), wherein the insulating material 11 is disposed on a side of the conductive wire 10, whereas the shielding material 12 is disposed on another side of the conductive wire 10, Next, the reinforcing material 13 is disposed beside the conductive wire 10 (step 102). The next step includes compressing the conductive wire 10, the insulating material 11, the shielding material 12, and the reinforcing material 13 (step 103). Then the insulating material 11 and the shielding material 12 are joined to each other so as to enclose and cover the conductive wire 10 and the reinforcing material 13, thereby forming a linear-shaped body (step 104).

In another process, for manufacturing the linear radio frequency identification antenna 100 according to the invention, the reinforcing material 13 is disposed beside the one conductive wire 10, wherein the step of compressing the conductive wire 10, the insulating material 11, and the shielding material 12 is accompanied by the step of compressing the reinforcing material 13, such that the insulating material 11 and the shielding material 12 are joined to each other so as to enclose and cover the conductive wire 10 and the reinforcing material 13, in order to enhance the rigidity of the linear-shaped body. The reinforcing material 13 is a plastic.

The linear radio frequency identification antenna 100 of the invention is for use with various mobile devices capable of near field communication (NFC), and is for use in reducing electromagnetic interference (EMI) effectively, so as to enhance the performance of identification equipment. The linear radio frequency identification antenna 100 of the invention is characterized by a linear-shaped surface having a shielding material thereon for reducing electromagnetic interference (EMI) and enhancing the performance of identification equipment.

Although the invention is fully illustrated with preferred embodiments and accompanying drawings, it is understandable that persons skilled in the art can modify the invention described herein and still achieve the benefits of the invention. Accordingly, the description below is intended to disclose the invention generally and broadly without limiting the invention.

What is claimed is:

1. A linear radio frequency identification antenna, comprising:

an insulating material;

a shielding material directly connecting with the insulating material to form a closed body; and a conductive wire covered by the closed body such that the conductive wire, the insulating material, and the shielding material together form a linear-shaped body, the insulating material is disposed on a side of the conductive wire, and the shielding material is disposed on another side of the conductive wire.

2. The linear radio frequency identification antenna of claim 1, further comprising a reinforcing material disposed beside the conductive wire and covered by the closed body.

3. The linear radio frequency identification antenna of claim 2, wherein the insulating material and the shielding material are connected to each other, and enclose and cover the conductive wire and the reinforcing material.

4. The linear radio frequency identification antenna of claim 3, wherein the reinforcing material provides rigidity along a length of the linear-shaped body.

5. The linear radio frequency identification antenna of claim 2, wherein the insulating material and the reinforcing material are plastics.

6. The linear radio frequency identification antenna of claim 1, wherein the conductive wire is a copper wire.

7. The linear radio frequency identification antenna of claim 1, wherein the shielding material is an electromagnetic interference shielding material.

8. A method for manufacturing a linear radio frequency identification antenna, comprising the steps of:

providing a conductive wire in a jacket extruder;

providing an insulating material in the jacket extruder and positioning the insulating material along a side of the conductive wire;

providing a shielding material in the jacket extruder and positioning the shielding material on another side of the conductive wire; and compressing the conductive wire, the insulating material, and the shielding material to directly join the insulating material and the shielding material together to form a linear-shaped, closed body, which encloses and covers the conductive wire therein.

9. The method of claim 8, further comprising the step of: providing a reinforcing material adjacent to the conductive wire.

10. method of claim 9, wherein the insulating material and the shielding material enclose and cover the conductive wire and the reinforcing material within the closed body.

* * * * *